US005721199A

United States Patent [19]

Moses

[11] Patent Number: 5,721,199

[45] **Date of Patent: *Feb. 24, 1998**

[54] VERSATILE MINERAL OIL-FREE AQUEOUS LUBRICANT COMPOSITION

[75] Inventor: David Louis Moses, Mercer Island, Wash.

[73] Assignee: Next Step Technologies, LLC., Mercer Island, Wash.

[ * ] Notice: The term of this patent shall not extend beyond the expiration date of Pat. No. 5,549,836.

[21] Appl. No.: 704,378

[22] Filed: Aug. 20, 1996

Related U.S. Application Data

[63] Continuation-in-part of Ser. No. 495,189, Jun. 27, 1995, Pat. No. 5,549,836.

[51] Int. Cl.[6] ..... C10M 173/00

[52] U.S. Cl. ..... 508/183; 508/208; 508/211; 508/212; 508/487; 508/488; 508/489; 508/513

[58] Field of Search ..... 508/183, 167, 508/208, 211, 212, 487, 488, 489, 513

[56] References Cited

U.S. PATENT DOCUMENTS

| | | | |
|---|---|---|---|
| 4,237,021 | 12/1980 | Andlid et al. | 508/183 |
| 4,257,902 | 3/1981 | Singer | 508/183 |
| 4,439,344 | 3/1984 | Albanese | 508/183 |
| 4,466,909 | 8/1984 | Stayner | 508/183 |
| 4,770,803 | 9/1988 | Forsberg | 508/183 |
| 4,800,034 | 1/1989 | Akao et al. | 508/183 |
| 5,549,836 | 8/1996 | Moses | 508/183 |

OTHER PUBLICATIONS

Smalheer et al. "Lubricant Additives", 1967 pp. 9–11, Ohio.

Schey, "Tribology in Metal Working", Friction, Lubrication and Wear, 1983, Canada, pp. 52, 53 and 59.

*Primary Examiner*—Margaret Medley
*Attorney, Agent, or Firm*—David L. Moses

[57] ABSTRACT

A substantially mineral oil-free aqueous composition useful either as is or to produce a dry lubricant film, the composition consisting essentially of water; a silicone oil, a vegetable oil or a mixture thereof; at least one waxy film-forming material selected from at least two of the following three groups: (a) saturated $C_{10}$–$C_{24}$ aliphatic monohydric alcohols, (b) saturated $C_{10}$–$C_{24}$ aliphatic monocarboxylic acids, and (c) saturated or monounsaturated $C_{10}$–$C_{24}$ aliphatic primary amides; an extreme pressure agent; and an anionic surfactant; nonionic surfactant or mixture thereof capable of stably dispersing the oil and film-forming mixture in the water.

5 Claims, No Drawings

VERSATILE MINERAL OIL-FREE AQUEOUS LUBRICANT COMPOSITION

TECHNICAL FIELD

This is a continuation-in-part of application Ser. No. 08/495,189 filed Jun. 27, 1995 now U.S. Pat. No. 5,549,836 issued Aug. 27, 1996.

This invention relates to substantially mineral oil-free aqueous compositions useful either as is or to produce a dry lubricant film.

BACKGROUND OF INVENTION

Metal working, which includes machining, drilling, and forming, uses large amounts of lubricating compositions. By far, the largest volume of lubricating compositions contain mineral oil. Recently water-based compositions have been developed to replace mineral oil compositions. The advantages of mineral oil-free lubricants are described in U.S. Pat. No. 4,237,021 to Andlid et al. Since water-based lubricants used in metal working are commonly diluted many times with water, the volume of waste from use of such compositions poses major costs. In King County WA., waste is considered a hazardous waste if it contains at least 100 ppm of mineral oil. To dispose of such wastes costs between $5 and $12 per gallon depending on the nature of the waste. The compositions of Andlid et al. use only components which are harmless to the environment thus avoiding this problem. Despite this advantage, environmentally friendly compositions such as those of Andlid et al have not achieved significant market penetration.

In my application Ser. No. 08/495,189 I describe versatile water-based lubricants having excellent lubricating properties. I have now found that adding an extreme pressure additive to these lubricants greatly increases the lubricating properties of these compositions in metal working applications. These compositions themselves contain no mineral oil, However it is often desirable to use a rust inhibitor and most commercially available rust inhibitors contain mineral oil. Accordingly, it is preferred to use rust inhibitors which do not contain mineral oil. However, rust inhibitors containing mineral oil can be used in the compositions of the invention where the metal working application itself introduces contaminants or where the composition of the invention is used to lay down a dry film (generally from about 0.2 to 05 mils) on the surface to be worked. In this latter case the mineral oil is retained in the film and when the part goes through the wash operation prior to finishing large volumes of water are used so that the oil in the waste water is well below 100 ppm.

Therefore it is an object of the invention to provide substantially mineral oil-free aqueous compositions having outstanding lubricating properties in metal working applications.

It is a further object of the invention to provide mineral oil-free aqueous compositions which provide outstanding lubricating properties in a wide range of metal working applications (including drilling, cutting, drawing, rolling, grinding, etc.) while using only components which permit disposal of wastes with minimal problems and costs. In many cases the waste lubricant can be disposed of directly to the sewer after testing for any contaminants introduced during use.

DESCRIPTION OF THE INVENTION

This invention provides a substantially mineral oil-free aqueous lubricant which may be used as is or applied to produce a dry film useful as a general lubricant and which is suited for modification into lubricant compositions tailored for specific lubricating applications. This basic lubricant comprises a mixture of at least one waxy film-forming material from at least two of (a) saturated $C_{10}$–$C_{24}$ aliphatic monohydric alcohols, (b) saturated $C_{10}$–$C_{24}$ aliphatic monocarboxylic acids and (c) saturated or monounsaturated $C_{10}$–$C_{24}$ aliphatic primary amides, the combination being blended with an extreme pressure additive ("EP") as hereafter described and a silicone oil and/or a vegetable oil to form a uniform mixture which is dispersed in water using a nonionic or anionic surfactant, or a mixture of the two.

The silicone oils are usually polydimethylsiloxane fluids available at viscosities from about 1000 centistokes to about 30,000 centistokes. Where the workpiece being lubricated is to be further processed (plating, painting or other post-finishing operations requiring a clean surface) the silicone should be an alkylaryl polysiloxane such as Dow Corning ® 203 which permits such further processing. Vegetable oils which may be used in place of silicone oil include canola (i.e. rapeseed), jojoba, soya, palm, olive, castor oil and mixtures thereof. The oil assists in forming the uniform blend of waxy alcohol, acid and/or amide which is more easily dispersed in water and also promotes film formation when the lubricant is applied to the surface to be lubricated. Silicone oil improves the operating temperature range for the lubricant films, the water resistance of the films and assists penetration of the lubricant compositions into difficult to reach areas when applied to the surfaces to be lubricated. Polydimethylsiloxanes should not be used where the work piece is subjected to any post-finishing requiring a clean surface. Recently alkylaryl polysiloxanes have been developed which permit proper post-finishing in most cases. Vegetable oil is preferred in those applications where the composition of the invention is used in liquid form during metal working because of ease of disposal. The ratio of oil to the waxy mixture of alcohol, acid and/or amide is not critical and will generally range from about ten parts of oil to one part of the waxy components to one part of oil to five parts of the waxy components. The higher the amount of oil, the softer the lubricating film produced on applying the composition, and conversely, the lower the amount of oil, the harder the film.

The extreme pressure agents used in the invention are oil-soluble, water-insoluble additives which are used in this capacity in conventional oil-based systems as well as prior art aqueous lubricant compositions such as those described in U.S. Pat. No. 4,257,902 to Singer and U.S. Pat. No. 4,800,034 to Akao et al. Suitable extreme pressure agents are described in U.S. Pat. No. 4,770,803 to Forsberg in column 33. Organic sulfides and polysulfides, metal dialkyldithiocarbamates, amine phosphates and aromatic amine phosphates are preferred. The EP agent should constitute at least 2 pads by weight of the overall composition. The upper limit is not critical but, generally, performance is not improved using more than about 5 pads by weight of the overall composition.

A wide variety of anionic and nonionic surfactants are commercially available. Suitable anionic and nonionic surfactants are described in U.S. Pat. No. 4,466,909 to Robed A. Stayner. The surfactant is preferably present in the amount of about 0.2 to about 0.6 pads by weight to a hundred parts of the overall lubricating composition.

Since the lubricants of the invention are water based, it is desirable to incorporate an effective amount of an anti-rust additive such as diethanolamine, triethanolamine, other organic and inorganic rust inhibitors and proprietary materials which do not contain mineral oil. A preferred material of this latter type is Na-Sul 425VI-X which has a canola oil base. It is available from King Industries, Inc., Norwalk, Conn. It is also desirable to incorporate a biocide. Suitable biocides include the Dowicils from Dow Chemical Co. and methychloroisothiazolinone and methylisothiazolinone, both from Rohm and Haas Co. Dowicil® 75 is particularly preferred as it is a wide-spectrum biocide giving long lasting protection at a concentration of 0.05 parts by weight to a hundred pads of the overall lubricating composition. In a particular preferred embodiment the polytetrafluoroethylene resin is added to the lubricant composition of the invention by incorporating an ultra-fine particle dispersion of the resin in the aqueous lubricant dispersion of the invention. The polytetrafluoroethylene improves the lubricity, release properties and wear properties of the lubricant films produced by the compositions of the invention. Preferably the polytetrafluoroethylene will constitute between 10% and 40% by weight of the combined alcohol, acid and/or amide. Where the work piece is to be further processed-i.e. any post finishing requiring a clean surface-the polytetrafluoroethylene should be omitted from the work piece. For high pressure applications, molybdenum disulfide should be substituted for the polytetrafluoroethylene. For high temperature applications, graphite should be substituted for the polytetrafluoroethylene.

Other optional ingredients of the lubricating composition of the invention include environmentally friendly water softeners, antifreeze additives to improve storability under freezing conditions, a defoamer where silicone oil is not used and a peptizing cleaner, i.e. a surfactant causing impurities on the surface being lubricated to disperse into colloidal form. Examples of such cleaners are Winsol 88119, a sodium laureth sulfate surfactant, and Winsol 10001, an anionic-nonionic blend, both available from Winsol Laboratories, Inc. of Seattle, Wash.

The aqueous phase of the compositions of the invention constitute from about 20% to about 96% by weight of the overall composition, depending on the application. Thus in a composition used in an aerosol can using dimethyl ether as the propellant, with dimethyl ether constituting 20% by weight of the overall composition, the aqueous phase made up of the combined dimethyl ether and water could constitute from about 75% by weight to 96% by weight of the overall composition. When brushed on the work in applications such as part forming, cutting, drawing, drilling, etc. the composition of the invention will preferably contain a lesser amount of water as in the range of about 20% to 50% by weight. The lubricating compositions of the invention used to form dry films contain from about 5% by weight to about 15% by weight of the overall composition of methanol, ethanol or isopropanol as an aid in assisting the evaporation of the water. In these cases the alcohol constitutes part of the aqueous phase. In aerosol packaging no alcohol is normally used as the propellant, dimethyl ether, serves the same function. However in most industrial metal-working applications, it is desirable to omit the alcohol to reduce organic vapors.

The waxy film-forming component of the invention comprises at least one waxy material from at least two of (a) saturated $C_{10}$–$C_{24}$ aliphatic monohydric alcohols; (b) saturated $C_{10}$–$C_{24}$ aliphatic monocarboxylic acids; and (c) saturated or monounsaturated $C_{10}$–$C_{24}$ aliphatic primary amides. Using at least one material from at least two of the listed classes of materials is believed to result in better film forming compositions and improved lubricity. While not critical, each component of the waxy mixture should constitute at least about 10% by weight, and preferable at least about 20% by weight, of the waxy mixture.

The compositions of the invention are produced by adding about ⅓ by weight of the water at about 82° C. to a tank equipped with a stirrer. The waxy ingredients in flake form are added with low speed agitation to prevent clumping. A master batch with about 10% by weight of the water and all the other ingredients (except the alcohol, if used) is prepared at about 38° C. with medium stirring until a uniform color is obtained. The master batch is then added gradually to the waxy ingredient/water emulsion with the rate of stirring increased to obtain a slight vortex and the stirring continued to again produce a uniform color. This rate of stirring is then continued while the rest of the water (at room temperature) is added slowly. If an alcohol is used it is added last.

TABLE I

| EXAMPLES | | 1 | 2 | 3 | 4 | 5 | 6 | 7 | 8 | 9 |
|---|---|---|---|---|---|---|---|---|---|---|
| (a) | Canola oil | 6.5 | 6.5 | 6.5 | 6.5 | 6.5 | 6.5 | 6.5 | 6.5 | 97 |
| (b) | Octadecanol | 2 | 2 | 2 | 2 | 2 | 2 | 2 | 2 | |
| (c) | Stearic acid | 2 | 2 | 2 | 2 | 2 | 2 | 2 | 2 | |
| (d) | Corrosion inhibitor | | | | | | | | | |
| (e) | Surfactant | 0.33 | 0.33 | 0.33 | 0.33 | 0.33 | 0.33 | 0.66 | 0.33 | |
| (f) | Peptizing cleaner | | | | | | | | | |
| (g) | Biocide | | | | | | | | | |
| (h) | Ethanol | | 10 | 10 | | 10 | 10 | | | |
| (i) | Polytetrafluoroethalene | | | | 2.3 | | | 2.3 | | 2.3 |
| (j) | Water | 89.17 | 79.17 | 76.87 | 86.17 | 76.17 | 73.87 | 85.14 | 83.87 | |
| (k) | Sulfurized lard oil <1% active sulfur | | | | | | | | | |
| (l) | Sulfurized lard oil 3% active sulfur | | | | | | | | | |
| (m) | Aromatic amine phosphate | | | | | | | | | |
| (n) | Amine phosphate compound | | | | | | | | | |
| (o) | Sulfurized isobutylene | | | | | | | | | |
| (p) | Zinc dialkyldithiocarbamate | | | | | | | | | |
| (q) | Sulfurized decene | | | | 3 | 3 | 3 | 3 | 3 | 3 |
| (r) | 5000 cs silicone | | | | | | | | | |

TABLE I-continued

| | | | | | | | | | |
|---|---|---|---|---|---|---|---|---|---|
| | fluid | | | | | | | | |
| (s) | 1000 cs silicone fluid | | | | | | | | |
| (t) | Corrosion Inhibitor in a mineral oil base | | | | | | | | |
| (u) | Surfactant | | | | | | | | |
| EXAMPLES (cont.) | | 10 | 11 | 12 | 13 | 14 | 15 | 16 | 17 | 18 |
| (a) | Canola oil | | 100 | 6.5 | 6.5 | 6.5 | 6.5 | 6.5 | 6.5 | 6.5 |
| (b) | Octadecanol | | 2 | 2 | 2 | 2 | 2 | 2 | 2 | 2 |
| (c) | Stearic acid | | 2 | 2 | 2 | 2 | 2 | 2 | 2 | 2 |
| (d) | Corrosion inhibitor | | | 3 | 2 | 2 | 2 | 2 | 2 | 2 |
| (e) | Surfactant | | 0.33 | 0.66 | 0.33 | 0.33 | 0.33 | 0.33 | 0.33 | 0.33 |
| (f) | Peptizing cleaner | | | | | | | | | |
| (g) | Biocide | | | 0.4 | *1 | *1 | *1 | *1 | *1 | *1 |
| (h) | Ethanol | | | | | | | | | |
| (i) | Polytetrafluoroethalene | | | | | | | | | |
| (j) | Water | | 84.17 | 82.44 | 83.17 | 83.17 | 83.17 | 83.17 | 83.17 | 83.17 |
| (k) | Sulfurized lard oil <1% active sulfur | | | | 3 | | | | | |
| (l) | Sulfurized lard oil 3% active sulfur | | | | | 3 | | | | |
| (m) | Aromatic amine phosphate | | | | | | 3 | | | |
| (n) | Amine phosphate compound | | | | | | | 3 | | |
| (o) | Sulfurized isobutylene | | | | | | | | 3 | |
| (p) | Zinc dialkyldithiocarbamate | | | | | | | | | 3 |
| (q) | Sulfurized decene | | 5 | 3 | | | | | | |
| (r) | 5000 cs silicone fluid | | | | | | | | | |
| (s) | 1000 cs silicone fluid | | | | | | | | | |
| (t) | Corrosion Inhibitor in a mineral oil base | | | | | | | | | |
| (u) | Surfactant | | | | | | | | | |
| EXAMPLES (cont.) | | | 19 | 20 | 21 | 22 | 23 | 24 | 25 | 26 |
| (a) | Canola oil | | 6.5 | 6.5 | 6.5 | | | | Same as | Same as |
| (b) | Octadecanol | | 2 | 2 | 2 | 3.25 | 3.25 | 3.25 | 24 but | 24 but |
| (Q) | Stearic acid | | 2 | 2 | 2 | 3.25 | 3.25 | 3.25 | cut back | cut back |
| (d) | Corrosion inhibitor | | 3 | | | 3 | | | 20 to 1 | 50 to 1 |
| (e) | Surfactant | | 0.33 | 0.33 | 0.33 | 0.33 | | | in water | in water |
| (f) | Peptizing cleaner | | | | | 1 | 1 | 1 | | |
| (g) | Biocide | | *1 | *1 | *1 | *0.5 | *0.1 | *0.1 | | |
| (h) | Ethanol | | | | | | 10 | 10 | | |
| (i) | Polytetrafluoroethalene | | | | | 2.3 | 2.3 | 23 | | |
| (j) | Water | | 82.17 | 85.17 | 85.17 | 76.87 | 71.27 | 69.27 | | |
| (k) | Sulfurized lard oil <1% active sulfur | | 3 | 3 | | | | | | |
| (l) | Sulfurized lard oil 3% active sulfur | | | | 3 | | | | | |
| (m) | Aromatic amine phosphate | | | | | | | | | |
| (n) | Amine phosphate compound | | | | | | | | | |
| (o) | Sulfurized isobutylene | | | | | | | | | |
| (p) | Zinc dialkyldithiocarbamate | | | | | | | | | |
| (q) | Sulfurized decene | | | | | 3 | | 2 | | |
| (r) | 5000 cs silicone fluid | | | | | 4.09 | 4.09 | 4.09 | | |
| (s) | 1000 cs silicone fluid | | | | | 2.41 | 2.41 | 2.41 | | |
| (t) | Corrosion Inhibitor in a mineral oil base | | | | | | 2 | 2 | | |
| (u) | Surfactant | | | | | | 0.33 | 0.33 | | |

*10% soln. in water

All of (a) through (p) are as set forth in Examples 1 through 18.

(a) High oleic canola oil from Cargill Foods (b) Alfol 18 NF from Vista Chemical (c) Hystrene 9718 NF from Humko Chemical Div., Witco Corp.

(d) Na Sul 425VI-X corrosion inhibitor in canola oil from King Industries, Norwalk, Conn.

(e) Tergitrol 15-S-3, a secondary alcohol ethoxylate from Union Carbide (f) Winsol 10001, an anionic and nonionic surfactant blend from Winsol Laboratories, Inc.

(g) 1-(3-Chloroally)-3,5,7 triaza-1-azoniaadamantane from Dow Chemical Co. as Dowicil 75

(h) Anhydrol Solvent Special, PM-4085 from Union Carbide (i) Fluotron, 110, ultra fine particle size polytetrafluoroethylene dispersion from Carroll Scientific, Inc.

(k) Na-Lube 5547 from King Industries (l) Na-Lube 5983 from King Industries (m) Vanlube 692 from R. T. Vanderbilt Co., Inc.

(n) Vanlube 672 from R. T. Vanderbilt Co., Inc.

(o) Vanlube 804-S from R. T. Vanderbilt Co., Inc.

(p) Vanlube AZ from R. T. Vanderbilt Co., Inc.

(q) Na-Lube EP-5915

(r) Polydimethylsiloxane from Dow Corning Corp.

(s) Polydimethylsiloxane from Dow Corning Corp.

(t) Aqualox 2268 from Alox Corp.

(u) Tergitol 15-S-9, a mixture of $C_{12}$–$C_{14}$ secondary alcohols ethoxylated to a molecular weight of 596, from Union Carbide.

The compositions of Examples 1–11 were tested by drilling 5/16 inch diameter holes ¼ inch deep into a piece of hardened steel. The drill produced an angled surface (about 45°) at the bottom of the hole. A 5/16 inch hardened steel rod was cut into 1½ inch lengths and the bottoms were ground to match the bottom of the hole. The lubricant of each example was placed in separate holes, the hardened rods put into a drill chuck, the drill turned on at a speed of 800 rpm. and the rods put into the respective reservoirs at a load of 200 lbs. The drill was timed in seconds to failure.

The compositions of Example 12–26 were tested by ASTM test designation D3233–93, method A (Falex Pin and Vee Block Method). In the regular Falex test, the vee block is immersed in the lubricant sample. This is referred to as the "wet" test in the following table. In the "dry" test the lubricant reservoir is removed and the two vee blocks and the pin are dipped in the lubricant and then dried for an hour to produce a dried film. The value reported is the load in pounds at which the lubricant can no longer support the load as shown in either test pin or shear pin breakage or inability to maintain or increase load. The results of these tests are set forth in Table II.

TABLE II

| | Falex (lbs) | | |
|---|---|---|---|
| Example | Wet | Dry | Test D (seconds) |
| 1 | | | 34 |
| 2 | | | 42 |
| 3 | | | 68 |
| 4 | | | 105 |
| 5 | | | 112 |
| 6 | | | 227 |
| 7 | | | 54 |
| 8 | | | 194 |

TABLE II-continued

| | Falex (lbs) | | |
|---|---|---|---|
| Example | Wet | Dry | Test D (seconds) |
| 9 | | | 87 |
| 10 | | | 31 |
| 11 | | | 182 |
| 12 | 4500 | 2200 | |
| 13 | 3450 | 2550 | |
| 14 | 3150 | 1400 | |
| 15 | 2450 | 1600 | |
| 16 | 3200 | 1650 | |
| 17 | 3600 | 2000 | |
| 18 | 2950 | 1900 | |
| 19 | 3500 | 1600 | |
| 20 | 2850 | 2000 | |
| 21 | 2450 | 1500 | |
| 22 | 3600 | 1850 | |
| 23 | 2050 | 1600 | |
| 24 | 3750 | 2000 | |
| 25 | 3300 | | |
| 26 | 3050 | | |

What is claimed is:

1. A substantially mineral oil-free aqueous dispersion useful as a lubricant for metal working comprising:

(A) about 20% to about 95% by weight of an aqueous phase;

(B) about 0.2% to about 0.6% by weight of an anionic surfactant, nonionic surfactant or mixture thereof;

(C) about 2% to about 5% by weight of an extreme pressure agent; and (D) the balance a mixture of (1) a silicone oil, vegetable oil or combination thereof, and (2) a waxy film-forming material from at least two of the three groups (a) saturated $C_{10}$–$C_{24}$ aliphatic monohydric alcohols, (b) saturated $C_{10}$–$C_{24}$ aliphatic monocarboxylic acids and (c) saturated or monounsaturated $C_{10}$–$C_{24}$ aliphatic primary amides;

the surfactant stably dispersing the mixture in the aqueous phase.

2. The composition of claim 1 further including a finely divided dispersion of polytetrafluoroethylene.

3. The composition of claim 1 wherein the extreme pressure agent is selected from the group consisting of organic sulfides, organic polysulfides, metal dialkyldithiocarbamates, amine phosphates and aromatic amine phosphates.

4. The composition of claim 1 wherein the oil is a vegetable oil and further including a mineral oil-free anti-rust additive and a mineral oil-free biocide.

5. The composition of claim 1 wherein the extreme pressure agent is selected from the group consisting of organic sulfides, organic polysulfides, metal dialkyldithiocarbomates, amine phosphates and aromatic amine phosphates and further including a finely divided dispersion of polytetrafluoroethylene.

* * * * *